US005271349A

United States Patent [19]

Magrini

[11] Patent Number: 5,271,349

[45] Date of Patent: Dec. 21, 1993

[54] WING SAIL STRUCTURE

[76] Inventor: Giorgio Magrini, Via Falcone, 5, 20123 Milano, Italy

[21] Appl. No.: 671,742

[22] PCT Filed: Sep. 14, 1990

[86] PCT No.: PCT/EP90/01564

§ 371 Date: Jul. 5, 1991

§ 102(e) Date: Jul. 5, 1991

[87] PCT Pub. No.: WO91/04191

PCT Pub. Date: Apr. 4, 1991

[30] Foreign Application Priority Data

Sep. 15, 1989 [IT] Italy ..... 21737 A/89

[51] Int. Cl.[5] ..... B63H 9/06

[52] U.S. Cl. ..... 114/39.1; 114/91; 114/103; 114/105

[58] Field of Search ..... 114/102, 103, 105, 91, 114/39.1, 90

[56] References Cited

U.S. PATENT DOCUMENTS

| | | | |
|---|---|---|---|
| 3,381,647 | 5/1968 | Keeler | 114/102 |
| 3,580,203 | 5/1971 | Martin | 114/102 |
| 3,724,412 | 4/1973 | Blecker | 114/90 |
| 4,341,176 | 7/1982 | Orrison | 114/102 |
| 4,386,574 | 6/1983 | Riolland | 114/103 |
| 4,624,203 | 11/1986 | Ferguson | 114/102 X |
| 4,685,410 | 8/1987 | Fuller | 114/102 |
| 4,909,170 | 3/1990 | Smart | 114/90 |

FOREIGN PATENT DOCUMENTS

| | | | |
|---|---|---|---|
| 241609 | 10/1987 | European Pat. Off. | 114/103 |
| 889560 | 1/1944 | France . | |
| 1464877 | 1/1967 | France | 114/103 |
| 1034945 | 8/1983 | U.S.S.R. . | |
| 1159829 | 6/1985 | U.S.S.R. . | |
| 2119730A | 11/1983 | United Kingdom . | |

*Primary Examiner*—Sherman Basinger

[57] ABSTRACT

A wingsail structure wherein the sail comprises a plurality of ribs encircling the mast and is guided slidably along the mast. A fabric skin is wrapped around the ribs. In a preferred embodiment, the mast is provided with at least two opposed, parallel longitudinal grooves forming respective guides for running carts attached to the ribs and is formed by a pair of parallel slats interconnected by cross-beams, said slats having an airfoil shaped cross-section.

10 Claims, 6 Drawing Sheets

WING SAIL STRUCTURE

DESCRIPTION

1. Technical Field

This invention relates to a wing sail structure of a type which comprises a mast, or supporting spar, mounted rotatably on a boat, and a sail which can be lowered.

More particularly, but not exclusively, the invention relates to a wing sail for boats, and throughout this specification reference will be made to such field of application for simplicity of illustration.

2. Background Art

Some special boats usually intended for racing events have been recently rigged, as is known, with rigid sails commonly called wing sails on account of their sectional profile duplicating basically that of an airplane wing.

It has been observed that this type of sail can improve the aerodynamic qualities of a sailboat and afford higher cruising speeds to be attained and maintained. It has, however, a fault in that it is difficult to handle and troublesome to lower.

To overcome this drawback, the prior art has proposed a solution described, for example, in USSR Patent No. 1034945.

That document discloses a wing sail of the rigid type comprising a plurality of segments with essentially airfoil sectional shape which are arranged on top of one another, on opposed sides with respect to a mast extending vertically upwards.

The segments are interconnected in pairs, on either sides of the mast. The adjacent sides of each segment pair are hinged together, whilst their end sides are guided slidably along the mast such that the sail structure can be folded down into two separate packs at the mast base.

The sail working arrangement consists of ropes or "lines" connected to the end segment, and sail area is reduced by decreasing the number of the segments hoisted.

This prior approach, while substantially achieving its objective, still has some shortcomings as pointed out herein below.

In the first place, sail area cannot be reduced, or the sail be reefed down, in a continuous fashion. Further, the airfoil shape of the sail can only be achieved effectively with the various segments fully extended vertically.

Further shortcomings originate from the excessively complicated construction of the sail, which is also the cause for high cost and low reliability.

A second prior technical solution is known from another USSR patent, No. 1159829, relating to a biplane wing sail made up of two parallel portions, symmetrical about the mast and each comprising like rigid airfoil segments which are structurally independent and aligned vertically above one another.

Each of said segments is hinged centrally to the free end of an arm which cantilevers perpendicularly out from said mast. Corresponding parallel segments are hinged to respective, opposed arms jutting out from a slide guided for sliding movement along the mast and whereto they are connected rotatably.

By first rotating the airfoil segments through 90° and then their supporting arms on each slide, such wingsail segments can be disposed with their axis parallel to the boat's deck, and each pair can be lowered by hauling down its corresponding slide.

This approach is also complicated and expensive to implement. In addition, the sail in the lowered condition is quite bulky and interferes with the normal handling of the boat.

The technical problem that underlies this invention is to provide a wing sail structure having a uniquely simple and functional construction whereby it can be reefed down or lowered altogether, according to necessity, with few operations, and at the same time obviate the shortcomings mentioned above in connection with the prior art.

DISCLOSURE OF INVENTION

This problem is solved by a wingsail structure as indicated being characterized in that said sail comprises a plurality of ribs encircling the mast and being guided slidably along said mast, and a fabric skin wrapped around said ribs.

In a preferred embodiment, said mast is provided with at least two opposed, parallel longitudinal grooves forming respective guides for running carts attached to the ribs.

The features and advantages of the wing sail structure according to the invention will become apparent from the following description of an embodiment thereof, given by way of non-limitative example with reference to the accompanying drawings.

BEST MODE OF CARRYING OUT THE INVENTION

Figure 1:
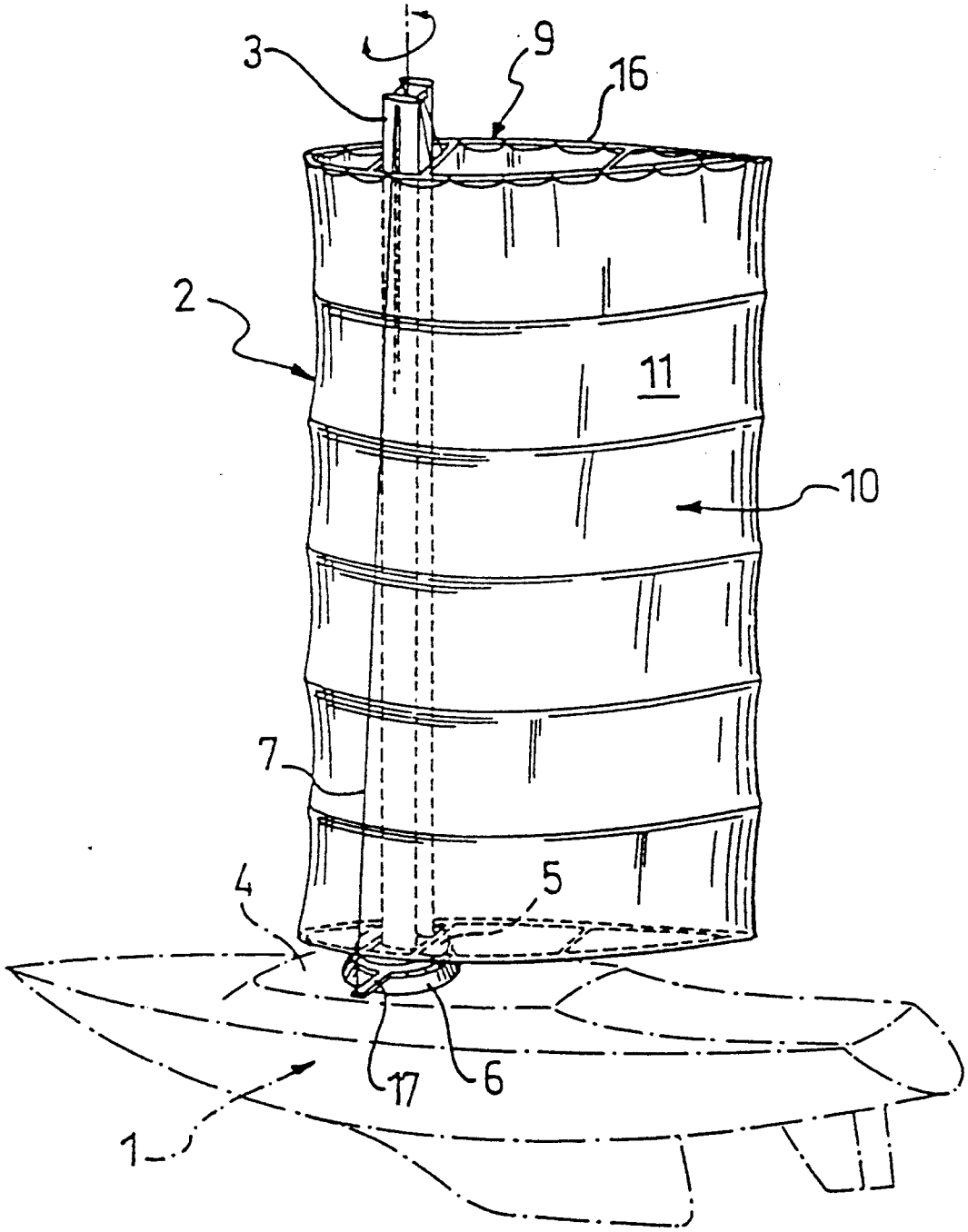
FIG. 1 shows schematically in perspective a boat rigged with the wingsail structure of this invention.
Figure 2:
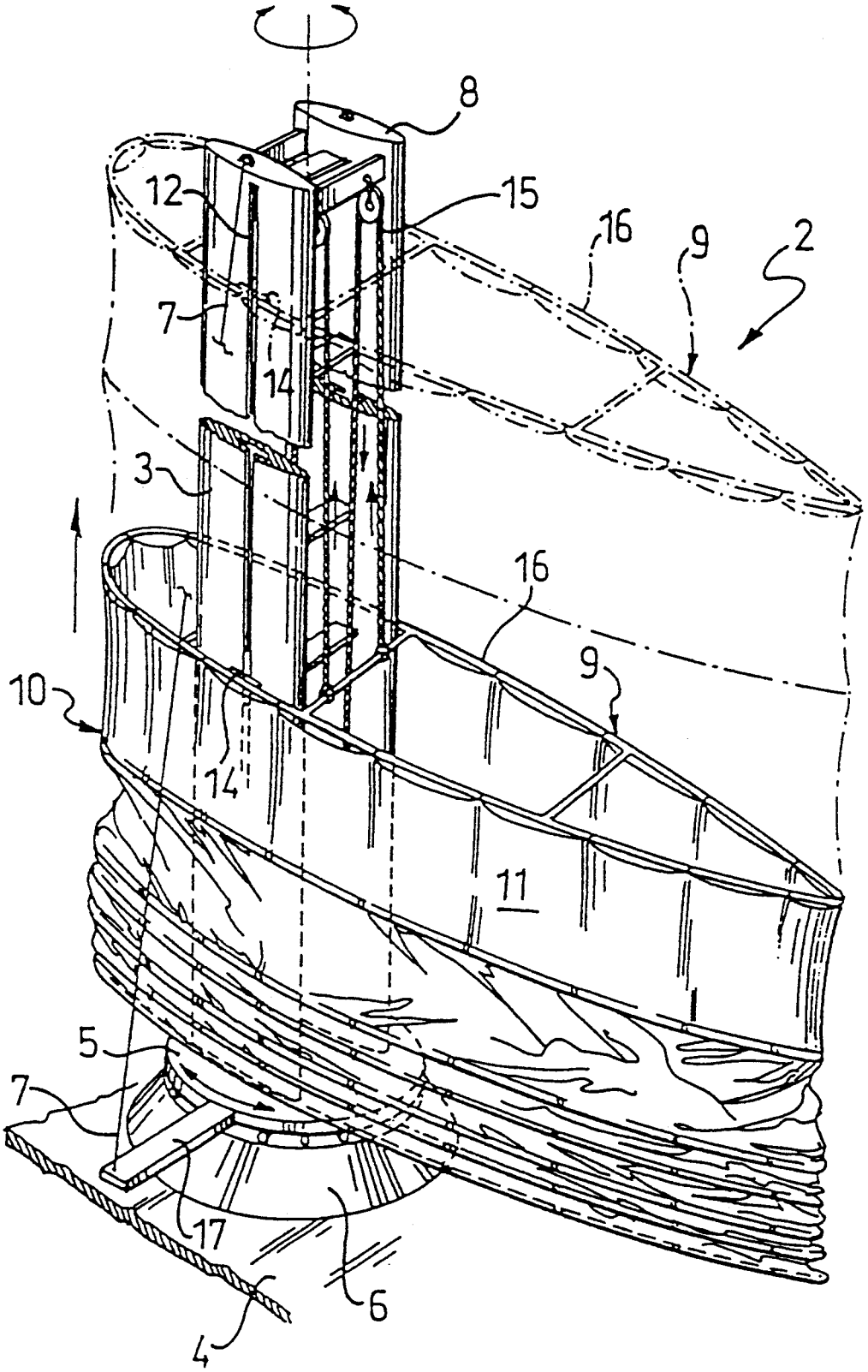
FIG. 2 is a perspective detail view of the wingsail shown in FIG. 1.

With reference to the drawing views, generally and schematically shown at 1 is a boat rigged with the wing sail structure 2 of this invention.

The structure 2 comprises a mast or supporting spar 3 which extends vertically upwards from a deck 4 of the boat 1.

The mast 3 has its bottom end fitted in a platform 5 which is mounted rotatably on a base 6 via bearings, not shown because conventional. The base is in turn made fast with the hull of the boat 1.

Thus, the mast 3 is made rotatable about a vertical axis such that the angle of attack of the wing sail relatively to the wind can be adjusted as explained hereinafter.

In another embodiment, side stays, indicated at 7, may be provided which would extend from the mast top 8 to the ends of arms 17 made fast with the platform 5 and jutting out therefrom.

In a preferred embodiment, the mast 3 is a lightened sectional extrusion having a substantially H-shaped cross-section. More particularly, the mast 3 is formed by a pair of slats 20 and 21 interconnected by cross-beams or ties 22.

These slats are formed from a composite material, or from aluminum, and have an airfoil-shaped cross-sectional configuration defining a biplane wing structure which, with the sail in the reefed down condition, will still develop some "lift" from the wind action.

The structure 2 is then completed by a monoplane configuration sail 10 which can be lowered and hoisted and comprises a plurality of so-called "ribs" 9 forming the sail framework and fitting slidably on the mast 3, and an outer fabric skin 11 wrapped around the ribs.

The ribs 9 are made preferably of metal and a closed, airfoil shape of reticulate construction. They enclose the mast and are guided for movement therealong.

For this purpose, the mast 3 is formed with oppositely located, parallel longitudinal grooves, indicated at 12, which constitute respective guides or runways for running carts 14 mounted internally at corresponding positions facing each of the grooves 12.

These carts 14 constrain each of the ribs 9 onto a substantially perpendicular plane to the mast 3, but prevent the ribs from turning about the mast.

The skin 11, which may be fabric or a synthetic plastics material, interconnects the ribs 9 in spaced-apart relationship.

At least one halyard 15 is also provided for hoisting the sail 10 up the mast. For this purpose, one end of the halyard 15 is connected to the top rib 9 as indicated at 16. The bottom rib is instead attached to the platform 5.

When hoisting up the sail 10, the ribs 9 are caused to slide vertically along the mast 3, while lying on respective planes substantially parallel to one another and perpendicular to the mast owing to the constraint exerted by the carts 14 and the stretched fabric skin.

With the sail hoisted up, the mast 3 will be substantially enclosed by the sail with the exception of the end 8, but can still be rotated with the platform 5 to trim the sail 10 according to the angle of incidence of the wind thereon.

The tension on the halyard(s) 15 will cooperate with the wind action to hold the sail stretched into its characteristic semirigid airfoil shape.

Advantageously, the sail area can be reduced, that is, the sail can be "reefed down" in sailor's parlance, whenever the wind strength requires it.

To that end, it will be sufficient to set, or conversely haul down, a section of the sail by securing any of the intermediate ribs on the platform 5, using ties or some other conventional means, and applying a pull force on the halyard 15.

In order to lower the sail 10, the halyard 15 is first slackened and the ribs 9 allowed to slide vertically down toward the mast base, while the skin 11 portions between each rib pair will collapse naturally.

It may be appreciated from the foregoing that the wing sail of this invention can be reefed or taken down, as the need may be, with a few moves. Its construction, moreover, is particularly simple and reliable.

Figure 3:
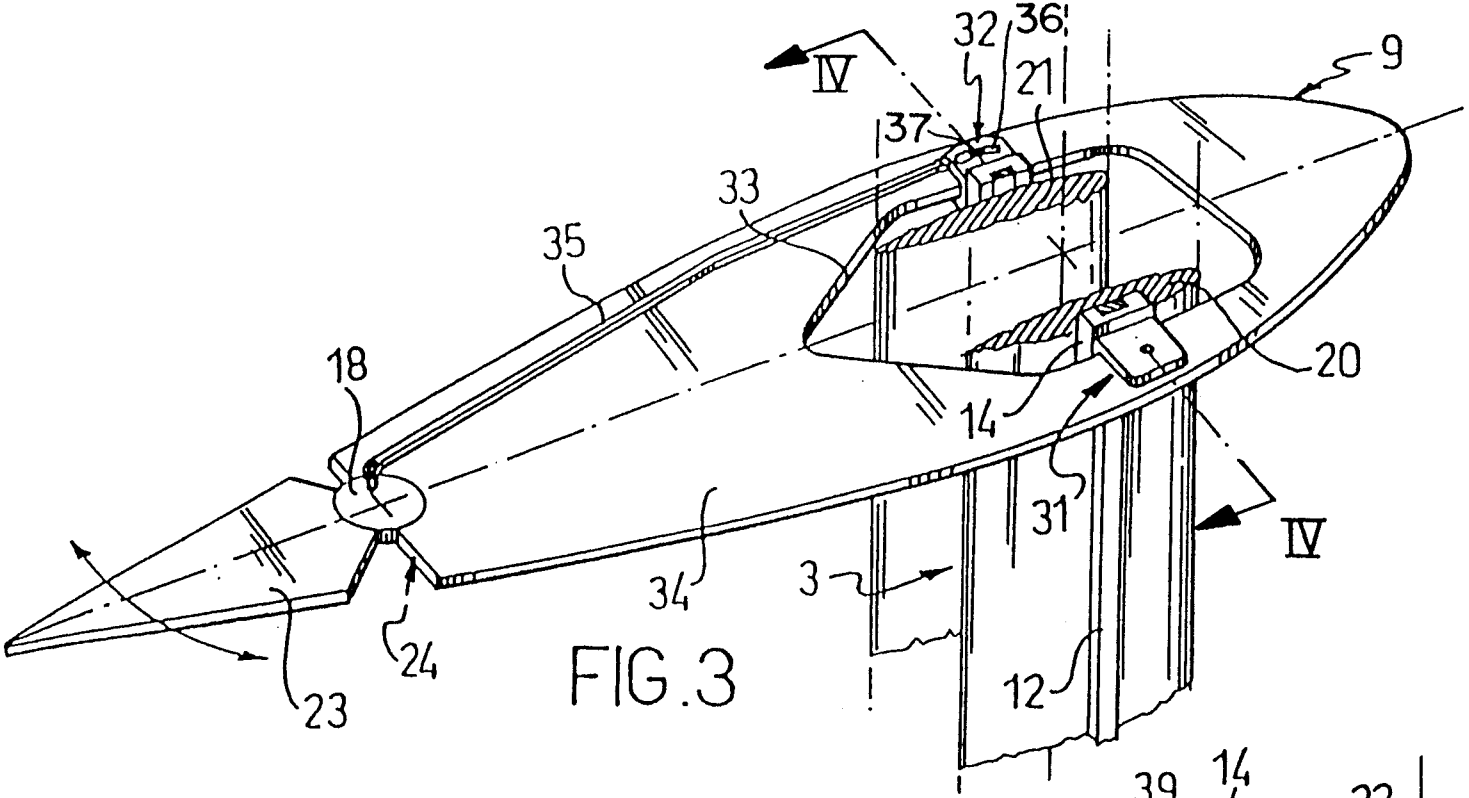
FIG. 3 is a perspective view of a rib as incorporated to the wingsail structure shown in FIG. 1.
Figure 4:
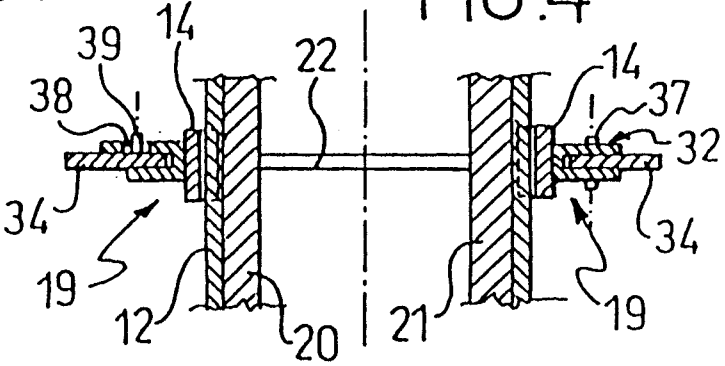
FIG. 4 is a sectional view of the detail shown in FIG. 3, taken along the line IV—IV.

With specific reference to the embodiment shown in FIG. 3, a variation of the wing sail structure according to this invention will be now described, wherein main and cooperating parts which have the same construction and operate in the same way as in the preceding embodiment are denoted by the same reference numerals.

In this variation, special means 19 are provided for guiding angularly the ribs 9 partway around the mast 3.

Also provided is a so-called "flap" 23 connected kinematically to said means 19.

More specifically, the means 19 comprise, on one side thereof, a hinge 31 mounted to one of the running carts 14 and fitting, therefore, between the rib 9 and the mast 3. Provided on the opposite side is instead a fork 32, in turn mounted to the corresponding cart 14 and fitting between the rib and the mast to operate in cooperation with the hinge 31.

Advantageously, the rib 9 is formed from a composite material with a flat board 34 to an airfoil profile which has a central aperture 33 wherethrough the mast 3 is passed and a so-called trailing edge 24 of the airfoil profile. Said flap 23 is attached pivotally through a hinge 18 proximate to said trailing edge, and a connection or tie rod 35 is provided between the fork 32 and the hinge point for the flap 23.

The fork 32 includes basically a curved slot 36 whose center of curvature is represented by the opposed hinge 31, said slot accommodating and guiding slidably therein a pin 37 rigid with the rib.

The simultaneous provision of the hinge 31 and the fork 32 affords for the hinge 9 an angular movement of predetermined amplitude about the fastening points represented by the carts 14. The amplitude of this angular movement is given essentially by the extension of the slot 36.

Any rotation of the rib would be caused by the force due to the pressure of the wind on the skin 11 of the sail enclosing the ribs. This resultant force induces a bending moment on the hinge 31 producing said partial rotation of the rib.

Automatically, because of the kinematic connection between the fork 32 and the hinge point of the flap 23 via the rod 35, a concurrent deflection of the flap is obtained which results in an increase of the airfoil lift coefficient.

A major advantage of the structure described hereinabove resides indeed in that the flap deflection is accomplished automatically and concurrently with the inception of the sail 10 lifting effect. This avoids for the wing sail structure 2 of this invention the need to include complex and hampering controls to be operated manually.

Figure 5:
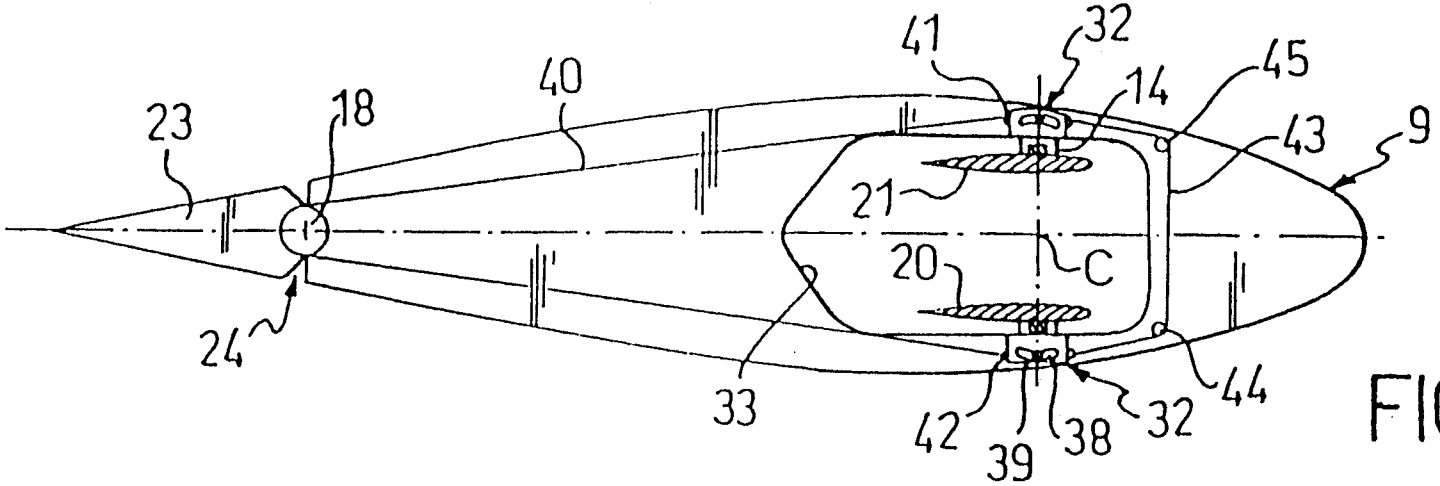
FIGS. 5 and 6 are respective top views of the detail in FIG. 3 and of a modified embodiment thereof.

In another embodiment shown in FIG. 5, the hinge 31 is also fork-like with a curved slot 38 wherein a pin 39 fits slidably which is rigid with the rib. In this case, a stay 40 is also provided which is wound around the hinge 18 of the flap 23 and has opposed ends 41 and 42 attached to the forks 32.

A further balancing stay 43 has opposed ends attached in turn to the forks 32, and is kept tensioned by oppositely located pulleys 44, 45 journalled on the rib 9 at the front portion of the same.

In this embodiment, the center of instantaneous angular rotation of the rib is represented by the point C and the flap 23 movement is permitted by the kinematic link represented by the stay 40. The provision of the additional stay 43 prevents the ribs 9 from translating parallel to its own centerplane without rotating.

Figure 6:
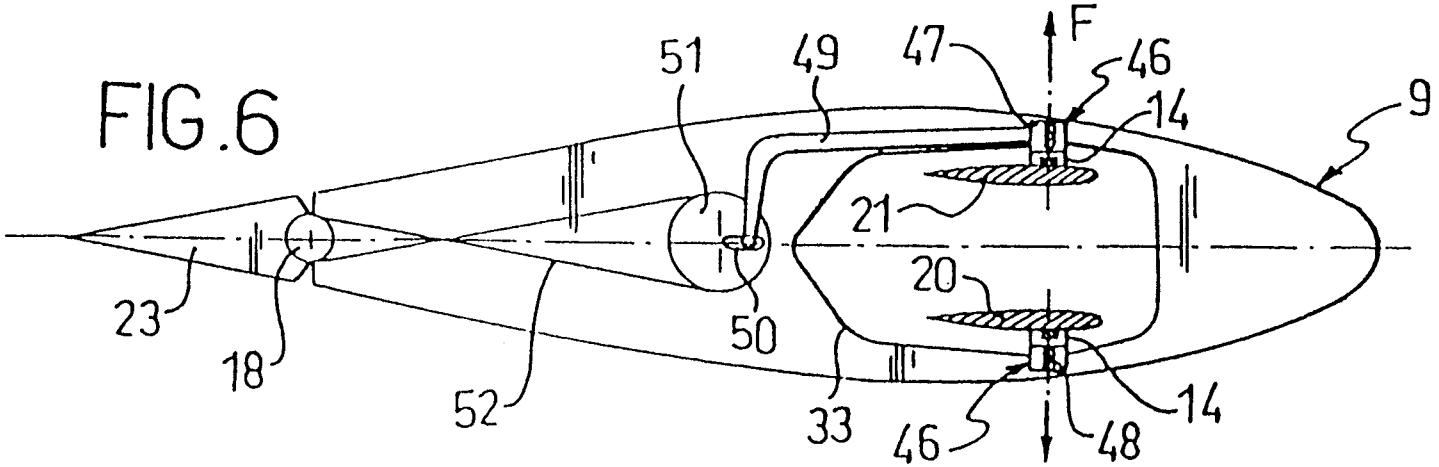
Figure 7:
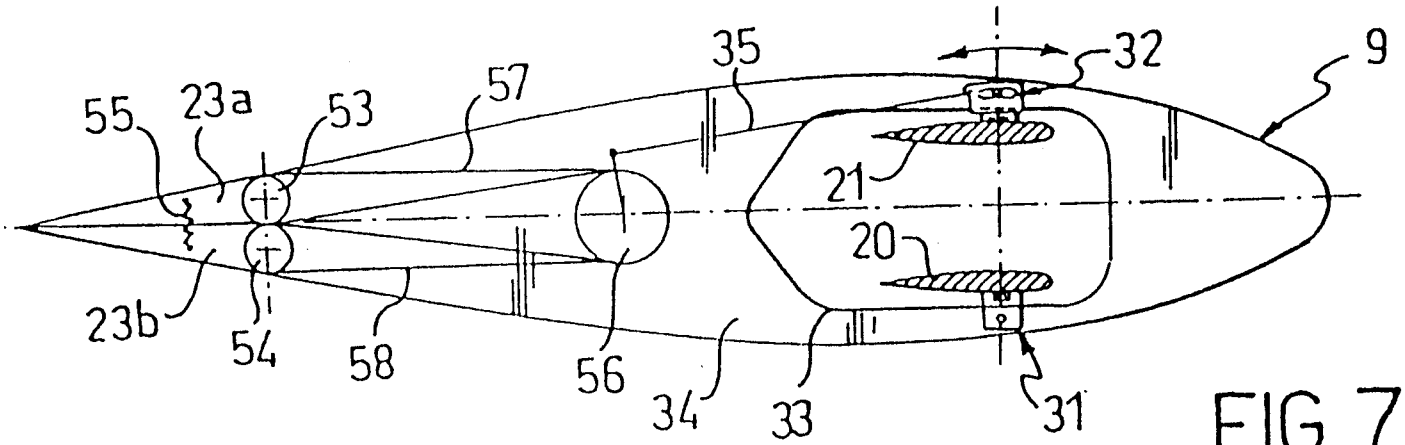
FIGS. 7 and 8 are respectively top views of a further embodiment of the detail shown in FIG. 3, under two different operating conditions thereof.
Figure 8:
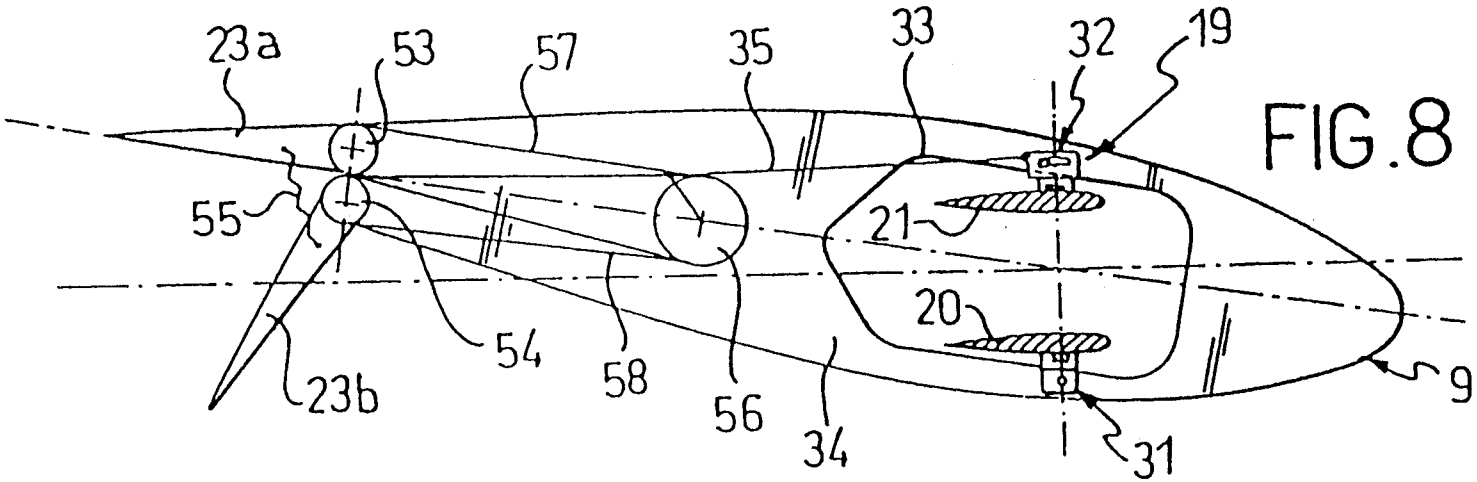
Figure 9:
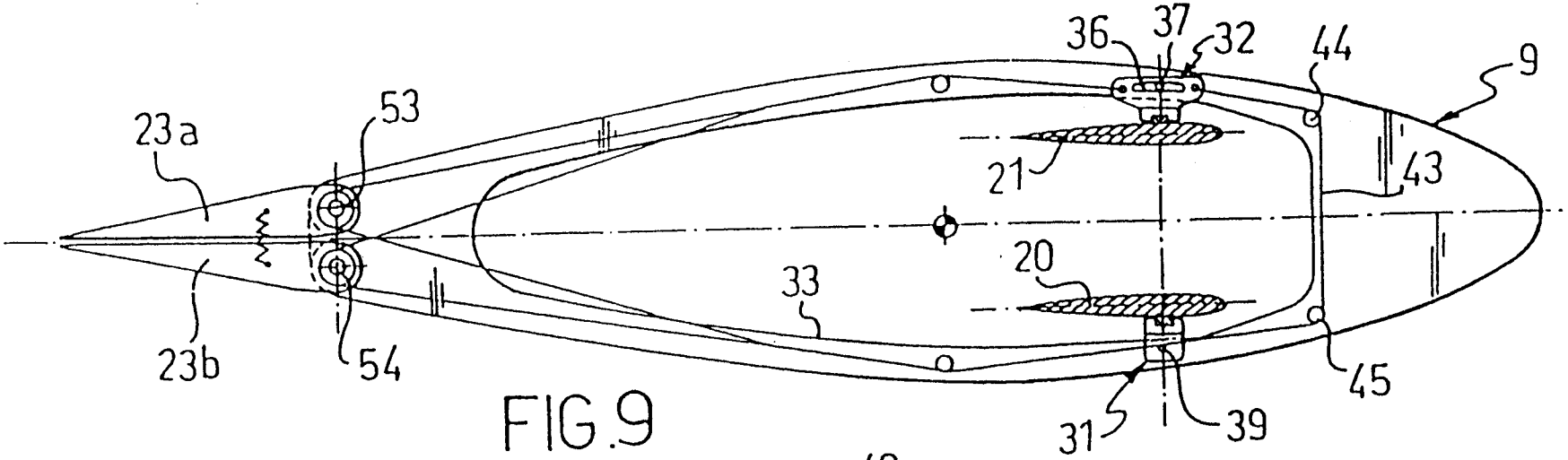
FIGS. 9 and 10 are respective top views of an improvement to the structure according to the embodiment shown in FIG. 7.
Figure 10:
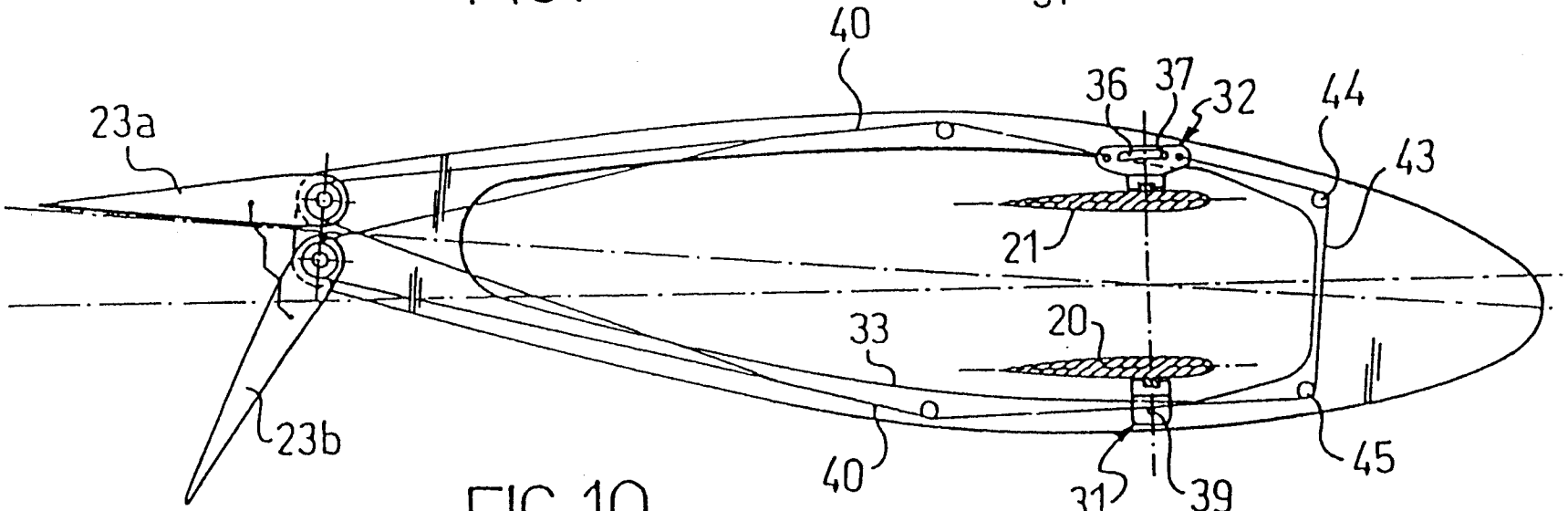

A further embodiment of the means 19 for guiding angularly the ribs partway around the mast is shown in FIG. 6.

In this case, the rib 9 is supported on oppositely located, slotted forks 46, each respectively mounted on a corresponding one of the carts 14. Each fork 46 is provided with a slot 47 extending across the major axis of the rib.

Respective pins 48, fast with the rib, are guided slidably in said slots 47 to permit of translation along the direction of the arrow F.

A rigid L-shaped arm 49 has one end attached to one of the forks 46 and the opposed end guided slidably in a slotted seat 50 formed in a pulley 51 which is journalled for free rotation on the rib 9 at a near-central location thereon.

A kinematic connection belt 52 is stretched in cross-over configuration between the pulley 51 and the hinge 18 of the flap 23.

In essence, in this embodiment, the kinematic link between the rib supporting means and the flap 23 is a crank mechanism effective to operate the flap automatically on the occurrence of transverse movements of the rib.

Finally and with reference to FIGS. 7 to 10, a further variation will be described wherein a pair of flaps 23*a*, 23*b* are provided, being both hinged to a location close to the airfoil trailing edge 24 through respective hinges 53, 54.

An elastic connection 55 constantly biases the flaps 23*a*, 23*b* toward a closed position wherein they lie against each other.

At a near-central location on the rib 9, there is provided a pulley 56 which corresponds substantially with the hinge 18 of the previous embodiments and is moved through a kinematic connection to the angular guide means 19 of the rib/e.g. via the rod 35.

Provided between the pulley 56 and the hinges 53 and 54 is a further kinematic connection including a pair of resilient belts 57, 58 laid in cross-over configuration with a belt run under tension and the adjacent run slackened. This causes the automatic movement of each of the flaps to occur with a predetermined time delay relatively to the movement of the other flap.

In essence, the first of the two flaps to be moved by the above-described kinematic connections will entrain the other flap by virtue of the elastic connection 55 and the setting of the belts 57, 58.

I claim:

1. A wing sail structure of a type which comprises a mast, or supporting spar, mounted rotatably on a boat, and a sail which can be lowered, said sail (10) comprising a plurality of ribs (9) encircling the mast and being guided slidably along said mast (3), and a skin (11) wrapped around said ribs (9) characterized in that said mast is formed by a pair of parallel slats (20, 21) interconnected by crossbeams (22), said slats having an airfoil shaped cross-section, and said mast (3) is formed with at least two oppositely located, parallel longitudinal grooves (12, 13) constituting respective guides for running carts (14) attached to the ribs (9), each of said grooves being formed in one of said slats.

2. The wing sail structure according to claim 1, characterized in that each rib (9) comprises at least one pair of oppositely located carts (14) secured internally at a location corresponding with and facing each of said grooves (12).

3. The wing sail structure according to claim 1, characterized in that said carts (14) provide constraint to the rotary movement of the ribs (9) about the mast (3).

4. A wing sail structure of a type which comprises a mast, or supporting spar, mounted rotatably on a boat, and a sail which can be lowered, said sail (10) comprising a plurality of ribs (9) encircling the mast and being guided slidably along said mast (3), a skin (11) wrapped around said ribs (9), guiding means (19) for guiding said ribs (9), partway about said mast and at least one flap (23) connected kinematically to the guiding means (19), and operated by movement of said ribs part way around said mast characterized in that said mast is formed by a pair of parallel slats (20, 21) interconnected by crossbeams (22), said slats having an airfoil shaped cross-section, and said ribs are airfoil shaped.

5. The structure according to claim 4, characterized in that said flap (23) is hinged at a location close to a trailing edge (24) of one of the airfoil shaped ribs.

6. The structure according to claim 4, characterized in that said guiding means (19) comprises on one side a hinge (31) fitting between the rib (9) and said mast (3), and on the other side a fork (32) fitting in turn between the rib and said mast to work in cooperation with the hinge (31).

7. The structure according to claim 6, further comprising a connection rod (35) between said fork (32) and a connection hinge (18) for said flap (23).

8. The structure according to claim 6, characterized in that said hinge (31) is also a fork-like shape (32).

9. The structure according to claim 4, characterized in that there is a pair of said flaps (23*a*, 23*b*) each hinged at a location close to a trailing edge (24) of one of the airfoil shaped ribs and being connected kinematically to said guiding means (19).

10. The structure according to claim 9, further comprising an elastic connection (55) extending between said pair of said flaps (23*a*, 23*b*).

* * * * *